United States Patent [19]

Hubert et al.

[11] 4,110,741

[45] Aug. 29, 1978

[54] DEVICE FOR MONITORING PHYSICAL ACTIVITY OF PERSONS

[75] Inventors: Jacques Hubert, Saint-Avold; Jean-Marie Ory, Heillecourt; Jean Bottin, Nancy; Claude Humbert, Heillecourt, all of France

[73] Assignee: Societe Chimique des Charbonnages, Paris, France

[21] Appl. No.: 761,483

[22] Filed: Jan. 21, 1977

[30] Foreign Application Priority Data

Jan. 20, 1976 [FR] France ..... 76 01419

[51] Int. Cl.[2] ..... G08B 21/00

[52] U.S. Cl. ..... 340/573

[58] Field of Search ..... 340/279, 261

[56] References Cited

U.S. PATENT DOCUMENTS

| | | | |
|---|---|---|---|
| 3,163,856 | 12/1964 | Kirby | 340/279 |
| 3,336,530 | 8/1967 | Sloan et al. | 340/279 |
| 3,984,704 | 10/1976 | Lakestani et al. | 318/116 |
| 3,984,705 | 10/1976 | George | 318/116 |

*Primary Examiner*—Glen R. Swann, III

*Attorney, Agent, or Firm*—Lerner, David, Littenberg & Samuel

[57] ABSTRACT

An individual monitoring device is carried by a person whose movements are to be monitored. The monitoring device comprises a displacement detector arranged to supply a continuously variable signal dependent on the positional changes of the device, signal processing circuit receiving the signal and at least one alarm device operatively connected to the signal processing circuit to provide an alarm in the absence for longer than a predetermined time of a signal due to the monitored person's "normal" movements. The signal processing means comprises a band pass filter for receiving the signal supplied by the displacement detector. The pass band of the filter only allows signals to pass which are due to changes in position of the device consequent upon the monitored person's normal movement.

9 Claims, 8 Drawing Figures

POWER
55
53a
54a
TRIGGERS
RAMP GENERATORS
FILTERS
52a
52b
52c
51
50
RECEIVER
AMPLIFIER 68
69
61a
59a
58a
53a
54a
52a
51
56
50
RECEIVER 60
57
REGULATOR
64
65
66
67
55

DEVICE FOR MONITORING PHYSICAL ACTIVITY OF PERSONS

BACKGROUND OF THE INVENTION

The present invention relates to apparatus for monitoring the activity of a person so as for example to provide an alarm if the person becomes immobile as a result of being unconscious or injured.

SUMMARY OF THE INVENTION

According to the present invention, there is provided apparatus for monitoring the activity of a person and comprising an individual monitoring device to be carried by the person whose activity is to be monitored, such device comprising a displacement detector, the displacement detector being arranged to supply a continuously variable signal dependent on positional changes of the device, and at least one alarm device connected to the displacement detector by signal processing means such that at least one such alarm is activated in the absence of the signal supplied by the displacement detector, the signal processing means comprising a band pass filter for receiving the signals supplied by the displacement detector the pass band of the filter being such that the said filter will only allow signals due to changes in variation of the device consequent upon the monitored person×s "normal"movements to pass.

Suitably a plurality of such individual devices are provided for use in combination each to monitor the activity of a different person, the devices each transmitting monitoring information to one or more central receiving devices. With such an arrangement, preferably the monitoring signal given out by each individual monitoring device is characteristic to that device to assist in identification and the central receiving device is capable of supplying an indication of the devices from which monitoring signals are, or are not, being received. In the preferred embodiment the central receiving device detects when a predetermined period of time has elapsed without a signal being received from one of the individual monitoring devices and then activates an alarm indicating that one of the peersons is immobile and provides identification of that person. The time delay helps prevent spurious triggering of the alarm.

The individual monitoring device can conveniently be mounted in a safety helmet or on any other mounting which can be carried by the person whose activity is to be monitored.

Preferably the pass band of the filter extends between approximately, 0.5 and approximately 3 Hz.

Preferably the or each individual monitoring device comprises a generator periodically supplying an identical signal whose presence controls the working of a radio transmitter provided in the device. Suitably the transmitter transmits a signal modulated by a low frequency from an oscillating circuit, which low frequency is characteristic of the corresponding individual device; the central receiving device suitably then includes low frequency filters receiving the signals after demodulation by the receiving devices.

Where larger numbers of persons are to be monitored, each individual monitoring device is conveniently arranged to transmit a coded binary signal and the central receiving device includes an appropriate binary decoding device to identify signals originating from the various individual monitoring devices.

Thus in an embodiment of the present invention, the persons to be monitored carry a mounting, for instance, a safety helmet, equipped with monitoring device including a motion detector. If the detected movements are "normal", the device transmits coded signals. A receiver at a distance decodes these signals and monitors them. If the movements disappear, such as in the case where the person is in a comma, or suffering from some immobilising injury, or if these movements are solely caused by the vibrations or tremors of a neighbouring machine, then after a certain lapse of time (for example 10 seconds) a whistling signal is transmitted by the device to warn the person that the central alarm will shortly be sounded unless he moves. If, another time limit (for example after the following 5 seconds) the person carrying the device has not reacted, the transmission of the coded signal ceases. When the receiver detects the absence of these signals, an alarm is activated with an indication of the place, for example, the working sector, where first aid must be given.

BRIEF DESCRIPTION OF THE DRAWINGS

The invention will be further described, by way of example, with reference to the accompanying drawings, in which.

DETAILED DESCRIPTION OF THE INVENTION

Figure 1:
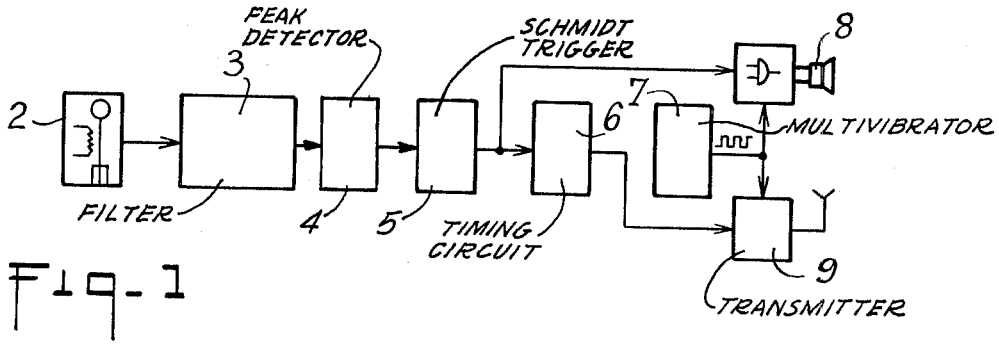
FIG. 1 is a block diagram of an individual monitoring device according to an embodiment of the invention.
Figure 2:
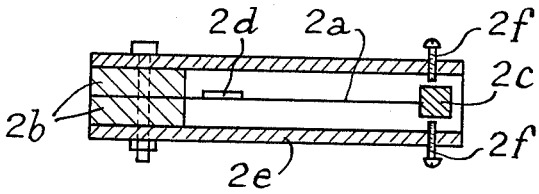
FIG. 2 shows a longitudinal section of an accelerometer used in the device of FIG. 1.

The embodiment of installation according to the invention illustrated in the drawings comprises:

(1) An individual monitoring device preferably in a watertight, inviolable electronic box, fixed on a mounting such as, for instance, a helmet. The device comprises the following components, located within the box: an autonomous supply source such as a battery or accumulator; a very sensitive, shock resistance accelerometer 2; an electronic amplifier and filter circuit 3 for signals from the accelerometer; detection circuits 4, shaping circuits 5, 6, modulation circuit 7 and an audible alarm 8; and a radio, ultrasonic, or optical transmitter 9.

(2) A receiver, adapted to the mode of transmission of the above device and comprising circuits for the detection of the absence of signal followed by a timing device and a control for sound and light alarms.

The device monitors the movements of a person and all the while his or her movements are "normal", the device transmits a signal to the receiver. If the person stops moving for a time, the device gives him or her an audible signal and, after a predetermined time period has elapsed, ceases transmission to the receiver, which in turn activates one or more alarms.

The detection of the movement of the person to be monitored is based on accelerometer 2, which consists of a flexible steel blade or foil 2a, one end of which is set between two foils 2b of insulating material, a fly weight 2c at the free end of the blade 2a, a piezoresistant gauge 2d bonded to the blade 2a, these components being mounted in a box 2e comprising two adjustable stop screws to protect the gauge 2d against excessively violent shocks. The frequency of the mechanical resonance of blade 2a is conveniently of the order of 15 Hz.

Figure 3:
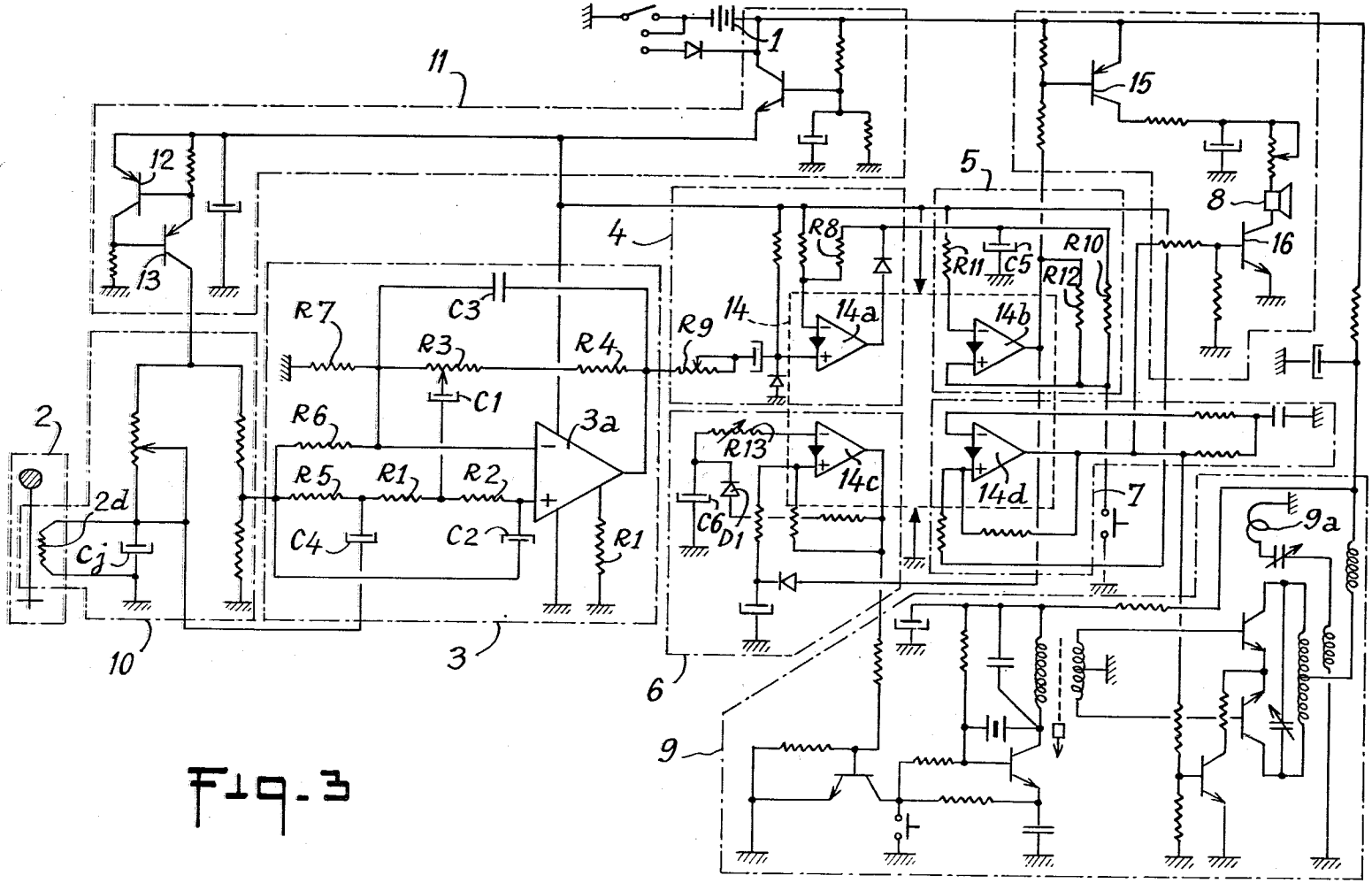
FIG. 3 is a detailed electrical circuit diagram of an embodiment of the device represented in FIG. 1.

Gauge 2d behaves as a variable resistance of approximately 1 KΩ. As shown in FIG. 3 this gauge is electrically connected in a Wheatstone bridge 10 supplied by a constant current of approximately 2 mA from battery 1, through a current regulating and filter circuit 11, so that the current through gauge 2d is independent of the fluctuations of battery 1. Two PNP transistors 12 and 13 form a constant current source supplying Wheatstone bridge 10. A 47μF condenser $C_j$ placed at the terminals of gauge 2d attenuates the frequencies which are higher than 3 Hz at a rate of 6 dB per octave.

The signal thus obtained at the terminals of bridge 10 is amplified and filtered by circuit 3 so that only the characteristic movements of the person carrying the device are taken into account. Tests have shown that the frequency range of the normal movements of a person have their maximum value between 0.5 and 3 Hz: thus a filter 3 is arranged so as to retain only this band.

Circuit 3 is a filter of a minimum order of 5. In the example shown, filter 3 has first order high pass characteristics of time constant: $t_1 = C_4R_5(R_1 + R_2)/(R_1 + R_2 + R_5)$ and fourth order low pass characteristics. The first break point (second order active) is at 0.6 Hz. The values of components $R_1$, $R_2$, $C_1$ and $C_2$ of the filter satisfy the equality condition $R_1C_1 = R_2C_2 = t_2$ ($t_2$ is the time constant of this break point). Damping at this break point is adjustable by means of potentiometer $R_3$ whose slider is connected to one of the armatures of condenser $C_1$.

The second break point (second order passive) has time constant $t3 \neq\neq C_j \cdot R_j \neq\neq C_3R_4$, $R_j$ being the resistance of gauge 2d. Here the damping is not adjustable.

For the frequencies between $$F1 = \frac{1}{2\pi t1} = 0.03 \text{ Hz and } F2 = \frac{1}{2\pi t2} = 0.6 \text{ Hz},$$

the unit has a maximum gain of $$\frac{R_3 + R_4 + R_6}{R_6}$$

i.e. approximately 220.

The integrated operational amplifier 3a used in circuit 3 is of a programmable type with a micro-power consumption. This programming (consumption/gain) is effected by means of resistance $R_7$.

Figure 5:
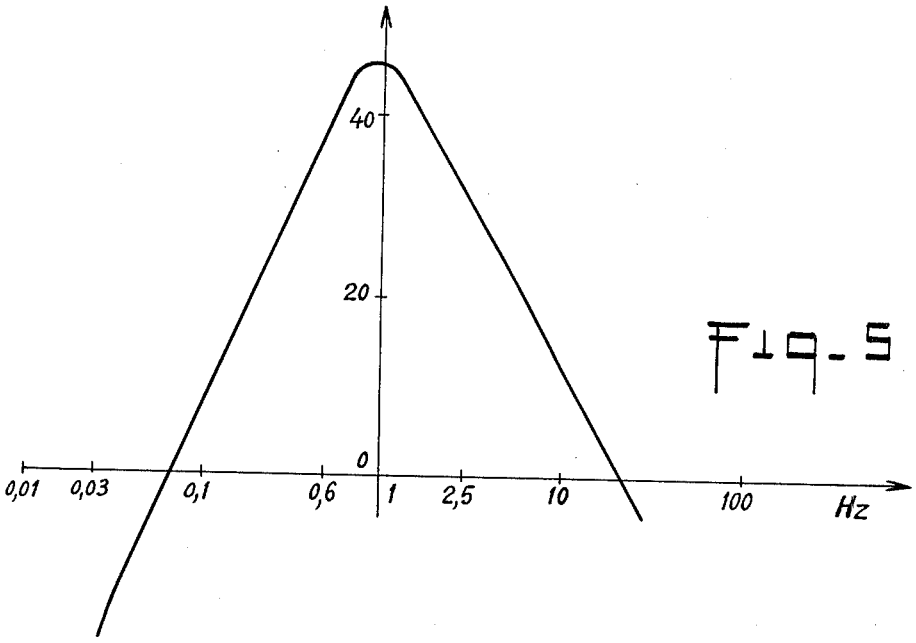
FIG. 5 is a sensitivity curve in terms of the displacement of the accelerometer used in the appliance of FIG. 1.

The point of this filter is that if one considers the displacement of the sensor instead of referring to the acceleration which it sustains, one obtains the curve of FIG. 5 which corresponds exactly to the range of "normal" displacement of the device.

Detection, timing and, modulation functions are effected by means of a single integrated circuit 14 known under the commercial reference number LM 3900 and combining four operational amplifiers 14a, 14b, 14c and 14d.

The amplifiers 14a to 14d are known as Norton-type amplifiers and have, at their output, a voltage which is proportional to the difference between the input currents.

The first circuit 4, which includes amplifier 14a is a peak detector with an adjustable gain equal to $R_8/R_9$. This circuit charges condenser $C_5$ which discharges into resistances $R_8$ and $R_{10}$.

The second circuit 5, which includes amplifier 14b is a flipflop or Schmidt trigger whose two thresholds of the hysteresis cycle equal respectively, $$\frac{R_{10}}{R_{11}} \cdot E \text{ and } \frac{R_{10} \cdot (R_{12} - R_{11})}{R_{11} \cdot R_{12}} \cdot E,$$

(E represents the supply voltage) and in the embodiment this gives 2.4 volts (threshold for rising signals) and 1.6 volts (threshold for falling signals).

Figure 4:
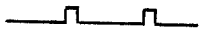
FIG. 4 represents the signal transmitted by a generator forming part of the monitoring device of FIG. 1.

When the output of circuit 5 is in the high state, this permits operation of circuit 6 which is based on amplifier 14c and which is a cyclical timing device capable of producing a signal such as the one shown in FIG. 4 i.e. a signal in the form of a train of square wave pulses which are, for example, each of a length of three seconds, and are regularly separated by intervals of 30 seconds. If the output of circuit 5 is in the low state, transistor 15 is saturated, which feeds transistor 16 which produces the sound in loudspeaker 8 coupled in series with the said transistors 15 and 16 across battery 1.

As mentioned above, the third circuit 6 is a cyclic timing device which produces a 3 second square wave pulse every 30 seconds. The interval between the said square wave pulses can be adjusted by means of variable resistance $R_{13}$. The output of this circuit 6 controls the working of radio transmitter 9. A delay of several seconds at the stop signal from this circuit 6 is obtained by means of fitting condenser $C_6$ between resistance $R_{13}$ and earth, and fitting diode $D_1$ between the output of amplifier 14c and the connection between condenser $C_6$ and resistance $R_{13}$.

Circuit 7 based on the fourth amplifier 14d is an astable multivibrator (with a 1:1 mark space ratio) which is continuously operating. Its function is, on the one hand, to control transistor 16 to produce an audible signal from loudspeaker 8 and on the other hand, of the modulation (all or nothing) of transmitter 9.

Transmitter 9, which is crystal controlled, does not have any special original features; it consists of a circuit currently used for remote control devices. The push-pull output stage of transmitter 9 supplies suitable power to tuned coil 9a which can, for instance, be accommodated in the mounting in the helmet.

Figures 6, 7, 8:
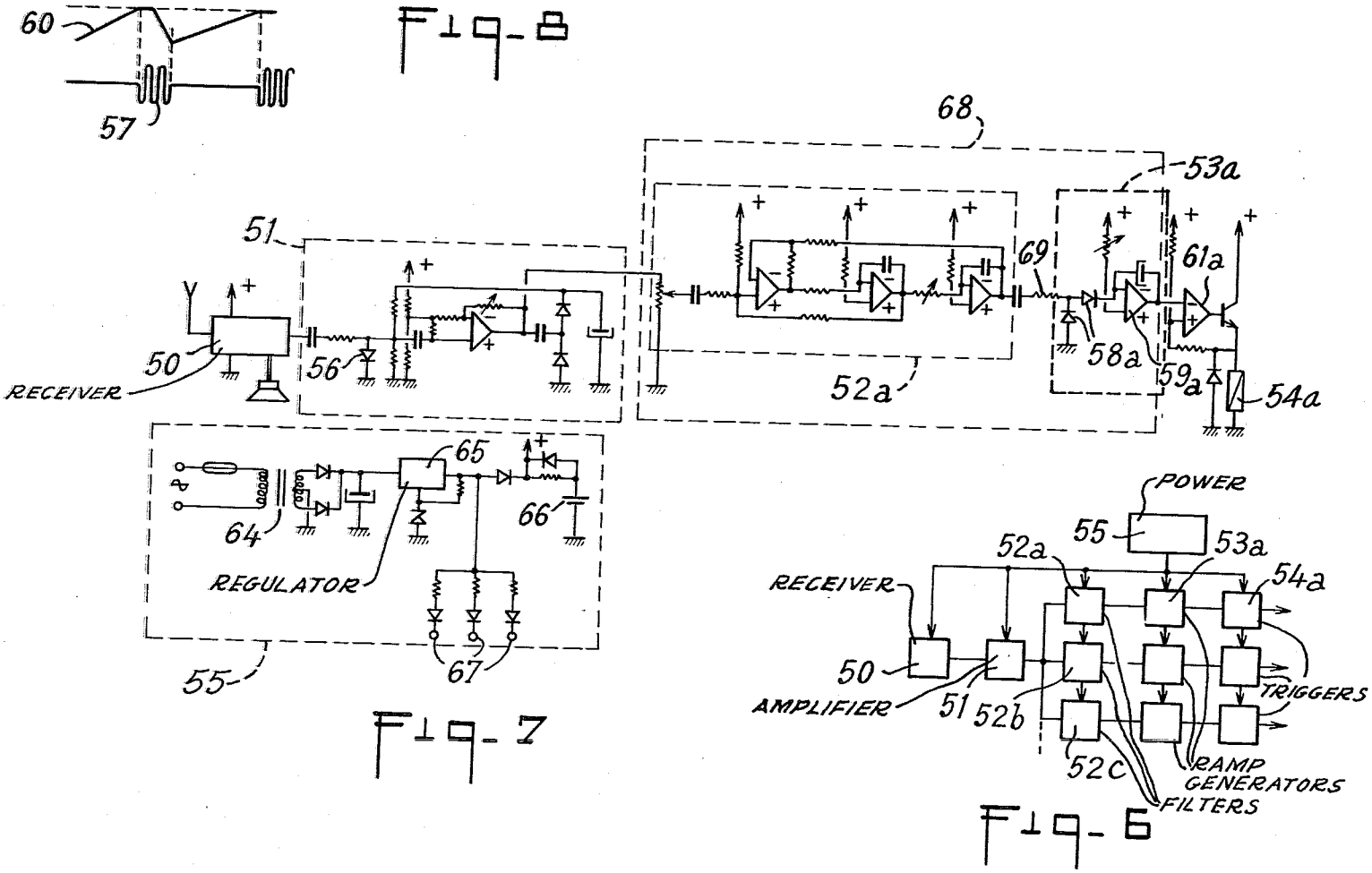
FIG. 6 is a block diagram of the receiver used with the device of FIG. 1 in an embodiment of the invention.
FIG. 7 is a detailed electrical circuit diagram of the receiver of FIG. 6.
FIG. 8 shows input and output signals of an integrator of the receiver of FIGS. 6 and 7.

The receiver shown in FIGS. 6 and 7 is tuned to receive the transmitter frequency from each personal monitoring device; low frequency filters make it possible to determine the origin of the signals received since each device has its own modulating frequency which is that of multivibrator 7 of that device.

The block diagram of the receiver set is shown in FIG. 6. It comprises a superheterodyne receiver 50 followed by amplifier 51 having an automatic gain control and by low frequency filters 52a, 52b etc. which are equal in number to the individual transmitters which may be operating simultaneously; there then follow ramp generators etc. and the triggers controlling relays 54a, 54b etc. The receiver is connected to composite supply input 55.

The layout of the receiver is shown in FIG. 7. The radio electric signals transmitted by the individual portable devices are received, amplified and demodulated by receiver 50; they are then brought to a constant amplitude by amplifier 51. As a variable resistance, the latter uses diode 56 whose bias point is variable. The low frequency filters 52a, 52b are active filters, preferably adjustable for setting up the installation. In that case, one can conveniently use three Norton amplifiers in an integrated quadruple amplifier system (commercial reference: LM 3900) and the remaining amplifier forms the ramp generator 53a, 53b. An alternating signal 57 passing from the corresponding filter 52a, 52b is detected by means of diodes 58a, 58b and is injected into the input of integrator 59a, 59b. The effect of this is to set the output of the said indicator (signal 60 of FIG. 8) to zero potential thus resetting the indicator to zero. In the absence of the signal 57 which absence indicates that the person monitored has stopped moving the output of the corresponding integrator 59 ramps upwards; unless the integrator is reset by the signal 57, the integrator output will ramp up to a value at which an alarm is triggered.

Signal 60 is applied to the hysteresis threshold detector (Schmidt trigger) 61a, 61b which control relays 62a, 62b. The thresholds of the hysteresis cycle are, for example, $\frac{2}{3}$ and $\frac{1}{3}$ of the supply voltage. The receiver circuit is designed in such a way that relays 62a, 62b are permanently supplied whilst the signals of the portable devices — or transmitters — are being received; and absence of these signals on one of the channels (indication of danger) leads to the ramp not returning to zero, but instead progressively increasing. When the latter attains the high threshold of corresponding trigger 61, the corresponding relay 62a is released and activates the alarm device.

The supply system 63 of the receiver set includes transformer 64 connected to an alternating network with integrated adjustment, filtering and electronic control 65. An in-circuit accumulator 66, which is charged automatically during normal mains operation, ensures the operation of the receiver even during mains breakdowns. The casing of the receiver set includes terminals 67 allowing for the recharging of the accumulators of the portable transmitters from the regulated supply system 63.

The connector system used between the receiver set and the portable devices for recharging the latter is effected in such a way that when the connection is used, the transmitter of the device is placed into a shut-down position and simultaneously, the alarm is placed out of service in the channel in question.

The filter and associated ramp generator unit for each channel can be placed on a small plug-in module 68. Each individual transmitter is thus associated with a decoding module, where the modulating frequency and the time constants (time between two pulses) and the ramp generator are coordinated. Resistance 69 determines the time necessary for resetting the integrator 59a, 59b to zero. The value is selected in such a way that the time for the zero resetting is sufficiently long to avoid a zero setting due to interference.

The operation of the installation described above and shown in the drawings is as follows:

The movements of the person to be monitored are converted into electric signals by means of accelerometer 2 of the monitoring device. These signals are amplified and filtered in such a way that only "normal" movements are detected. Vibrations are not taken into account.

The presence of these signals controls the operation of transmitter 9. The latter is usually of a short wave radio type transmitter but of course, in certain cases (high levels of electrical interference, work of divers underwater etc.) an ultrasonic acoustic transmitter (for example, see U.S. Pat. No. 3,984,704 issued to Lakestani et al. on Oct. 5, 1976 or U.S. Pat. No. 3,984,705 issued to George on Oct. 5, 1976) or an optical transmitter may be used.

While the transmitted signals are being received by the receiver, no alarm is given. When the person has remained immobile for at least 10 seconds, for example, he or she is advised by a sound signal emitted by loudspeaker 8 in the individual apparatus. Also, the radio transmission ceases. The receiver has a timing device (the integrator and associated Schmidt trigger) so that if the transmission is not re-established in the next few seconds, an alarm is given.

When one of the signals does not materialise within a given time limit, for example 30 seconds, the timing device consisting of integrator 59a, 59b and the Schmidt trigger 61a, 61b activates an alarm and at the same time, an indicator indicates the channel concerned.

Thanks to the low frequency coding of the transmission described above, the simultaneous monitoring of several persons is made possible. Where it is necessary to use a large number of transmitters, rather than a respective single frequency being used to provide identification of the signal from each device, it is preferred to use a digital coding system (pulse train series) and the receiver will include a binary decoder.

Of course, designers may make various modifications to the systems or procedures; these have been described above for the purpose of giving an example, which is not meant to be exhaustive.

Thus, accelerometer 2 can be replaced by a different type of detector. This detector should preferably be such, however, that it supplies a continuously variable signal dependent on the changes in position of the person carrying it. This detector may, for instance, be of the type detecting the movements of the image of a fixed point of light.

We claim:

1. Apparatus for monitoring the movements of a person, comprising an individual monitoring device to be carried by the person whose movements are to be monitored, said device comprising a displacement detector, the displacement detector being arranged to supply a continuously variable signal dependent on the positional changes of the device, signal processing means receiving said signal, the signal processing means comprising a band pass filter for receiving the signals supplied by the displacement detector, the pass band of the filter being such that the said filter will only allow signals due to changes in position of the device consequent upon the monitored person's "normal" movements to pass, and at least one alarm device operatively connected to the signal processing means to provide an alarm in the absence of said signals due to the monitored person's "normal" movements.

2. Apparatus according to claim 1, wherein said individual monitoring device further comprises means for generating and for transmitting over a distance a monitoring signal indicating the presence of the said "normal" movements, and wherein said alarm device includes means for activating an individual alarm perceptible by the monitored person in the absence of said "normal" movements and wherein the apparatus further comprises a central alarm, remote from said device, at least one receiving device for receiving the said monitoring signal and a signal detecting device linked to said receiving device and comprising tuning means capable of activating said central alarm when said monitoring signal indicating the presence of said "normal" movements is absent for a predetermined space of time.

3. Apparatus according to claim 1 wherein said displacement detector comprises an accelerometer.

4. Apparatus according to claim 1, which includes a safety helmet, the individual monitoring device being mounted in said safety helmet.

5. Apparatus according to claim 1, wherein the pass band of the filter is from 0.5 Hz to 3 Hz.

6. Apparatus according to claim 2, wherein the monitoring signal is an acoustic signal.

7. Apparatus according to claim 1, wherein the processing means comprises a signal generator and signal presence detector which can receive the signal supplied by the filter and activate, in the presence of the signal, the signal generator to supply the alarm device with a signal constituted by a periodic series of square wave pulses.

8. Apparatus according to claim 7, wherein a radio transmitter is provided, each square wave signal pulse of the signal generator controlling the operation of the radio transmitter.

9. Apparatus according to claim 8, wherein the transmitter is arranged to transmit a signal coded to identify the transmitter.

* * * * *

UNITED STATES PATENT AND TRADEMARK OFFICE

CERTIFICATE OF CORRECTION

PATENT NO. : 4,110,741

DATED : August 29, 1978

INVENTOR(S) : Jacques Hubert, et al.

It is certified that error appears in the above-identified patent and that said Letters Patent are hereby corrected as shown below:

Column 2, line 14, after the word "If," insert

-- after --

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*